United States Patent [19]

Hopkins et al.

[11] 4,153,113

[45] May 8, 1979

[54] SUBSEA DRILL-THRU MANIFOLD CENTER

[75] Inventors: John W. Hopkins, Sunnyvale, Calif.; Claude A. Sellars, Houston, Tex.

[73] Assignee: Lockheed Petroleum Services, Ltd., New Westminster, Canada

[21] Appl. No.: 856,784

[22] Filed: Dec. 2, 1977

[51] Int. Cl.[2] ..... E21B 7/12

[52] U.S. Cl. ..... 166/356; 166/366

[58] Field of Search ..... 166/0.5, 0.6, 358, 366; 175/5, 7, 8, 9; 61/69 R, 69 A

[56] References Cited

U.S. PATENT DOCUMENTS

| | | | |
|---|---|---|---|
| 3,525,388 | 8/1970 | McClintock | 166/0.5 |
| 3,527,294 | 9/1970 | Weiss et al. | 166/0.5 |
| 3,601,189 | 8/1971 | Weiss et al. | 175/7 |
| 3,638,720 | 2/1972 | Thomas | 166/0.5 |

*Primary Examiner*—Ernest R. Purser
*Assistant Examiner*—Richard E. Favreau
*Attorney, Agent, or Firm*—H. Donald Volk

[57] ABSTRACT

A subsea drill-thru manifold center for petroleum well completion and production is disclosed. The manifold center is compartmented so each well is within its own gas tight compartment. A removable sleeve through which the well is completed is mounted in each compartment. After each well is completed its sleeve is removable so it can be put in production in the conventional manner.

3 Claims, 4 Drawing Figures

SUBSEA DRILL-THRU MANIFOLD CENTER

BACKGROUND OF THE INVENTION

The growing worldwide need of energy has expanded the search for oil and gas on the ocean floor to greater depths. At the present time it is contemplated to put oil and gas wells at ocean depths that only a few years ago were considered inaccessible.

At the same time there has been a tremendous concern about accidental leakage of gas and oil in the ocean and its effect on the sea life in particular and the environment in general. To take care of the need for gas and oil without adversely affecting the environment, it has been proposed that subsea wellhead cellars be utilized.

One such wellhead cellar system is disclosed in U.S. Pat. No. 3,601,189. This patent discloses a system in which a center pipe guide, tension member and a drilling template are used in a unique way to install the wells and to complete the wells. Specifically, the following steps are followed in installing the wellhead cellar of the preferred embodiment. After a bore is drilled in the desired area, a caisson is set in the bore and cemented in place. A drill template and guideline system is made as an integral part of the caisson. The template locates the upper ends of the wells in a closely spaced cluster, it being understood that the wells can be slant drilled, if desired. After all wells are drilled and capped an atmospheric wellhead cellar is lowered onto and sealed to the template. All water is then evacuated from the interior of the wellhead cellar by equipment carried by a personnel transporter. Thus, the wellhead cellar provides a single air chamber over the individual wells. A watertight personnel transporter operating with an internal pressure of one atmosphere can engage a hatch trunk on the wellhead cellar to permit personnel to be transported from the water surface to the interior of the wellhead cellar to permit the completion of the wells, installation of Christmas trees, flow lines and other necessary equipment to put the wells on-line.

The system shown in U.S. Pat. No. 3,601,189 performs quite well, except that it requires that all wells be drilled prior to the wellhead cellar being installed. Also, the number of wells that can be drilled and put on-line is restricted by the relatively small size of the wellhead cellar.

Moreover, it has been found desirable to isolate each well within its own chamber so that the well can be completed and reworked without disturbing the other wells.

SUMMARY OF THE INVENTION

In the present invention the basic structure consists of two large diameter cylinders and two small diameter cylinders that define a rectangular platform. These four cylinders constitute the basic drilling template. A skirt is provided at the outer edge of each cylinder for penetration into the subsea floor. A base is provided between the cylinders for supporting ballast.

The large diameter cylinders are compartmented with gas tight bulkheads to provide a separate compartment for each well. Each compartment has a spool welded to the top and bottom of a centerline bore through the cylinder. A removable sleeve is installed between the upper and lower spools and in combination with the spools provides a conduit through the compartment for the drilling and completion operations.

Other features of the present invention will be apparent from the following description, claims and drawings, which, by way of illustration, show the preferred embodiment of the present invention. Other embodiments of the invention embodying the same or equivalent principles may be used and structural changes may be made as desired by those skilled in the art without departing from the present invention and the purview of the appended claims.

DESCRIPTION OF THE PREFERRED EMBODIMENT

Figure 1:
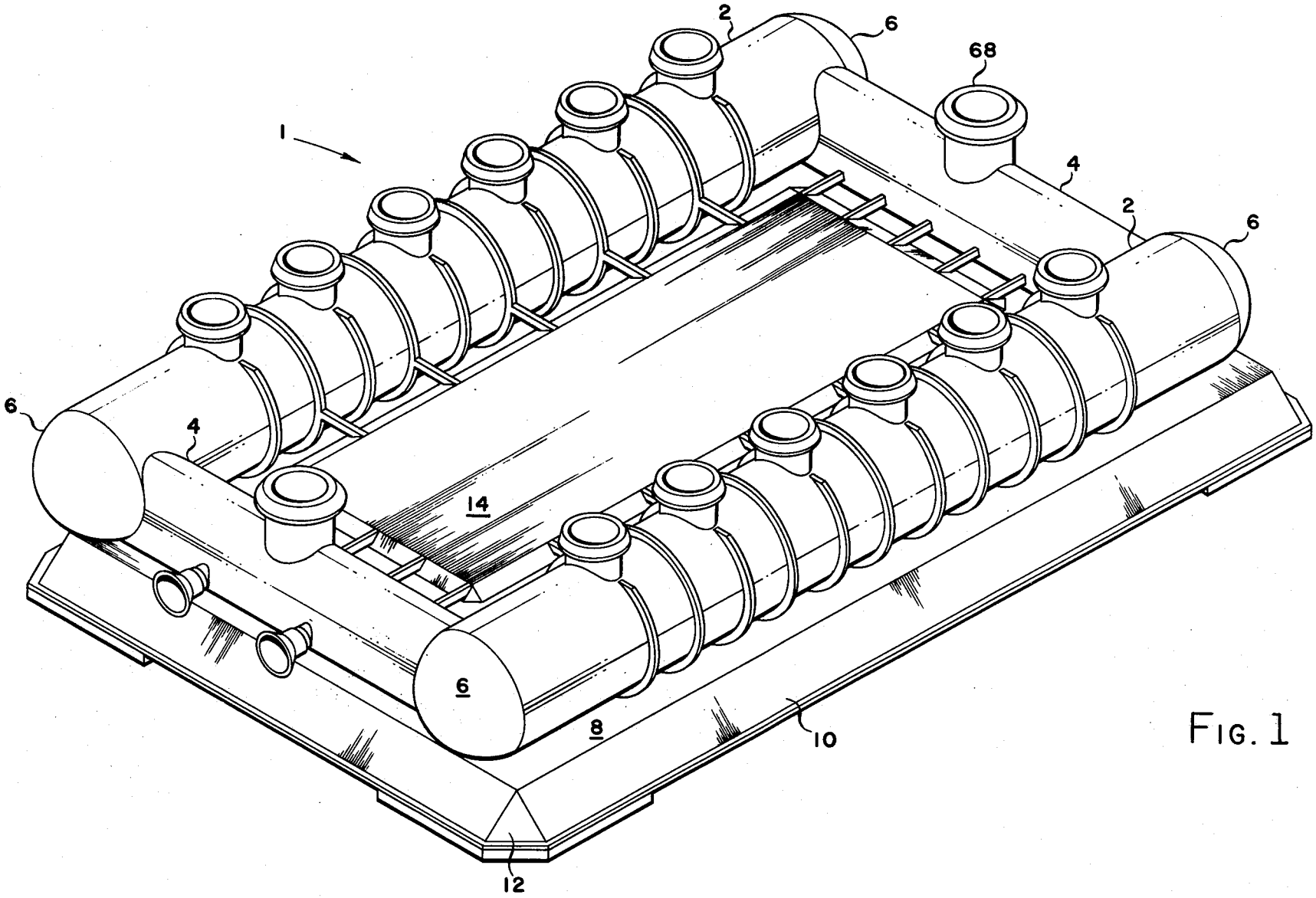
FIG. 1 is a perspective view of the preferred embodiment of the invention.

In the drawings the same reference numbers are used throughout the several views to designate the same or similar components. Referring first to FIG. 1, there is shown a perspective view of the preferred embodiment of the drill-thru subsea manifold center 1 of the present invention. The basic structure consists of two large diameter well cylinders 2 interconnected by two smaller production cylinders 4 to form a rectangular platform.

The well cylinders 2 are closed on the ends with end caps 6. The well cylinders are of relatively large diameter, for example, 14 feet in diameter, while the production cylinders are of a lesser diameter, for example 9 feet.

The cylinders are mounted on a flat base 8. The outer edges of base 8 are folded downward to form a skirt 10. Gussets 12 connect and reinforce the corners where the skirts 10 intersect. The skirt 10 and gussets 12 are provided under the cylinders to form a base for supporting the drill-thru subsea manifold center on the subsea floor. A large support pad (not shown) actuated by hydraulic jacks is mounted on each corner of the base for leveling the manifold center when necessary.

Mounted inboard from the cylinders and supported by the cylinders is a ballast base 14.

Figure 2:
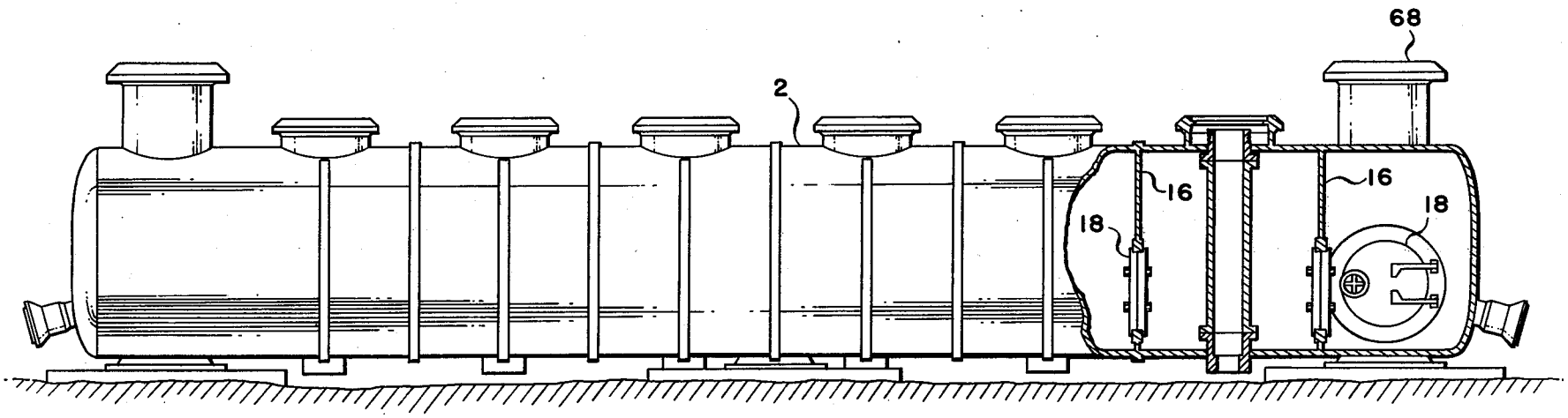
FIG. 2 is a side elevation of the preferred embodiment of the invention with portions broken away to show interior details.
Figure 3:
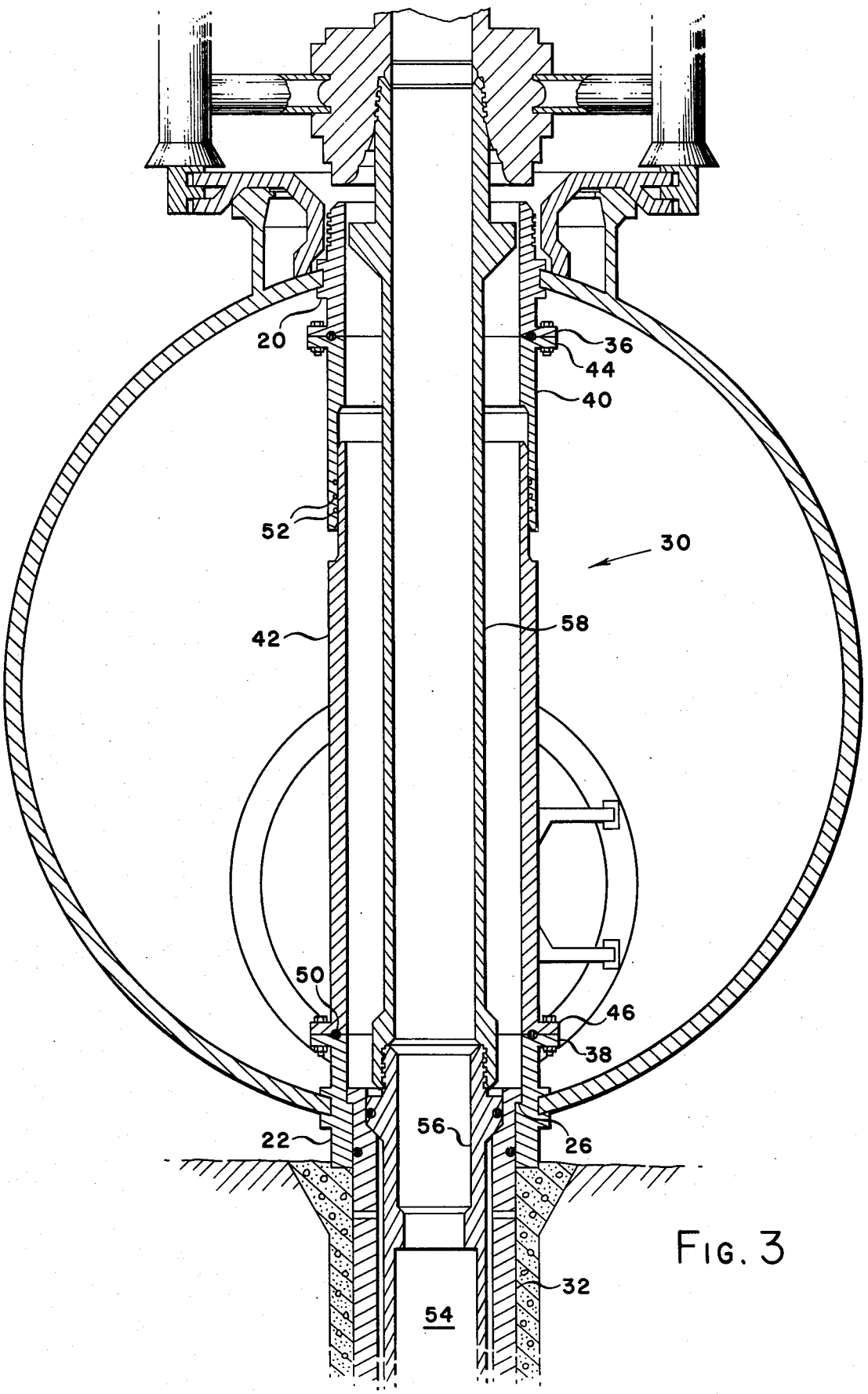
FIG. 3 is a sectional view of the well cylinders in FIG. 2 showing details of the spools and removable sleeve; and, FIG. 4 is a sectional view of the well cylinder in FIG. 2 showing the installation of the Christmas tree and the flow lines.
Figure 4:
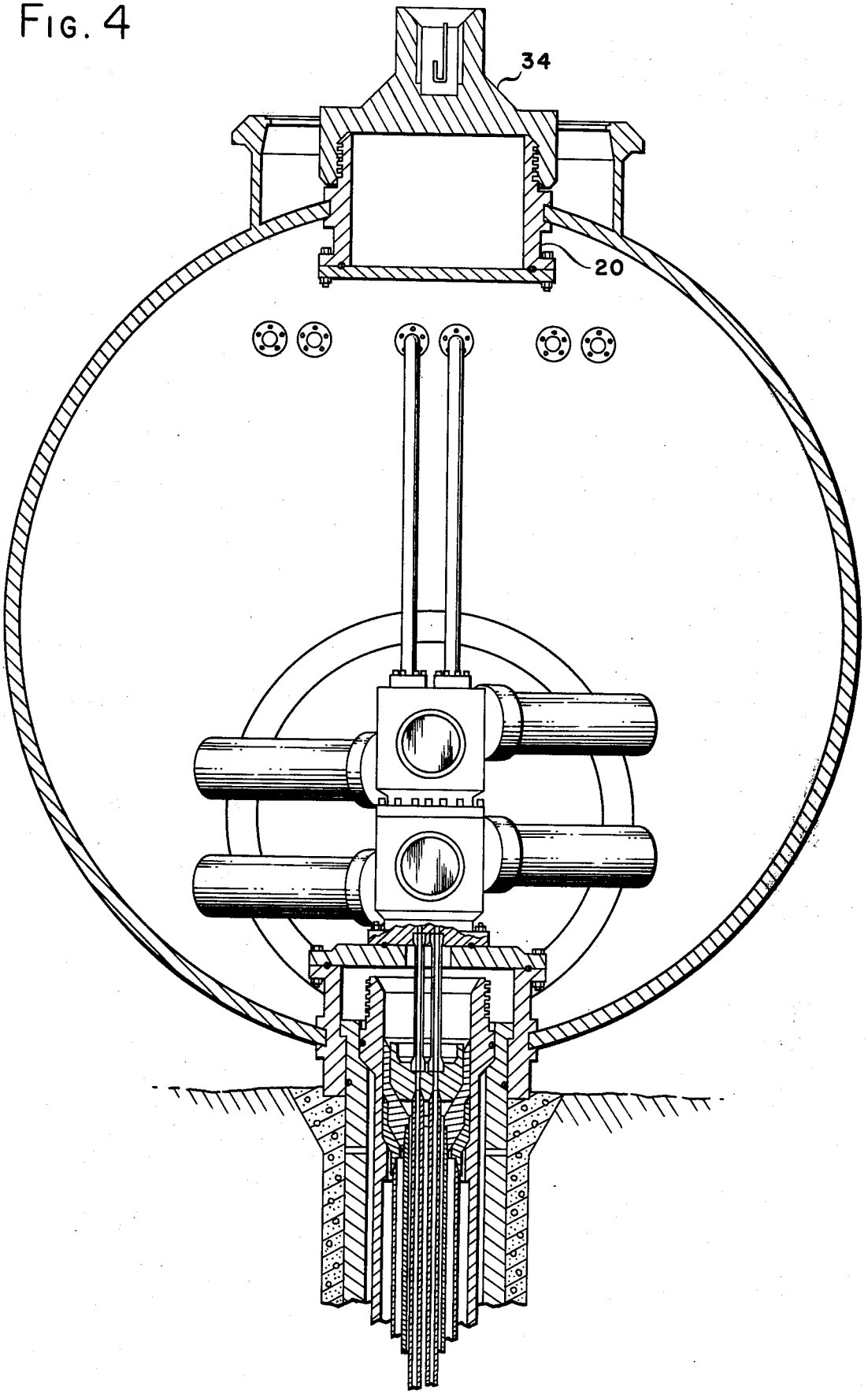

Referring to FIG. 2, FIG. 3 and FIG. 4, the well cylinders 2 are compartmented by gas tight bulkheads 16. Gas tight hatches 18 in each bulkhead 16 provide access between the compartments and between the end compartments of the well cylinders 2 and the production cylinders 4.

Welded to the top of each compartment is a top spool 20. The top portion of the top spool 20 projects externally to the well cylinder 2 and is threaded externally to receive a cover plate 34. The lower portion of the top spool 20 terminates in an external annular flange 36. Flange 36 includes a bolt pattern.

A bottom spool 22 is welded to the bottom of each compartment coaxially with the top spool 20. The bore of the bottom spool includes a tapered shoulder 26. The bore of the bottom spool 22 and the tapered shoulder 26 are sized such that a conductor can be hung from the tapered shoulder in a sealed mated relationship as will be explained below.

The upper portion of the bottom spool 22 terminates in an external annular flange 38. Flange 38 includes a bolt pattern.

A removable sleeve 30 is installed between the top spool 20 and the bottom spool 22 and bolted to their respective flanges. Removable sleeve 30 comprises a first tubular section 40 and a second tubular section 42 which is telescopically movable into and out of the first tubular section. The upper portion of the first tubular section terminates in an external annular flange 44 that mates with flange 36 of the top spool. A seal 48 is mounted between flange 36 and flange 44 in a conventional manner and provides a fluid and pressure tight seal. Similarly, the lower portion of the second tubular section terminates in an external annular flange 46 that mates with flange 38 of the bottom spool. Seal 50 is mounted between flange 38 and flange 46 in a conventional manner and provides a fluid and pressure tight seal.

Seals 52 are provided between the first tubular section and the second tubular section to provide a fluid and pressure tight seal.

The removable sleeve 30, in concert with the top spool 20 and the bottom spool 22, provides a conduit through the chamber for the drilling and completion operation while allowing the compartment to remain dry. In other words, all drilling and completion operations are conducted through the removable sleeve.

The establishing of an installation will now be described with reference to both FIG. 3 and FIG. 4.

The first step in establishing the installation is to bore a hole into the ocean floor through the removable sleeve. A conductor sleeve 32 is then hung from the bottom spool 22 and cemented in place. The bore hole for this pipe is usually jetted by high pressure water or it may be drilled if the bottom is hard or rock laden. This pipe, which usually is 80 to 200 feet long, serves, in effect, as a piling and all subsequent drilling operations are carried on through it.

The first string of casing 54, usually 16¾ inches in diameter or larger, is supported or hung off by a casing bowl 56 that rests on an inner shoulder of the conductor pipe. This process is normal drilling practice and standard equipment is utilized. The length of this casing is dependent upon the depth of a level of subsurface consolidation that will contain some degree of well and fluid pressures. The pipe is cemented into the well bore.

A short riser section 58 is either pre-installed or screwed onto the threaded section of the hanger segment of the casing hung off in the conductor. This riser extends up through the conductor sleeve and provides at its upper end the standard fitting for blowout preventer connectors. A drilling riser 60 is attached above the preventers and all subsequent drilling operations are accomplished in a conventional manner.

After all the drilling and casing operations are completed, the production tubing is run and set. It hangs off in the hanger bowl as shown in FIG. 4. The production formation is perforated and the well is ready to produce. Removable plugs (not shown) in the tubing are set and locked in the tubing. These are standard items and may be set at two levels: near the production zone and just below the tubing hanger. These are removed by pump-down tools or wireline tools after the wellhead is installed.

After the well is completed the blowout preventers are removed, the riser unscrewed and recovered and the cover plate 34 to the top spool is screwed down by the drill rig. The chamber is now ready for manned entry and the completion operation.

The drill rig then moves to the next well and repeats the process just described. While the drilling operation is still in process, previously drilled wells can be completed.

In the completion operation, a watertight personnel transporter, for example, the personnel chamber shown in U.S. Pat. No. 3,601,189, is lowered from a mother barge and mates with hatch 68 on the production cylinders 4. The crew transfers from the personnel transporter into the well chambers to put the wells on-line.

The wellhead may be any combination of valves and operator selected by the customer. An adapter for mounting the wellhead may be screwed onto the threaded segment of the first casing string or it may be mounted on a plate as shown in FIG. 4. Erection of the wellhead is entirely conventional. It may be pressure tested as required and the control system exercised. The production lines are plumbed into preinstalled headers and, with removal of the tubing plugs, the well is ready to go on stream.

Pressure integrity of the cover plate 34 is tested by a valve in the upper sleeve cover. If the cover is leaking, the service capsule is lowered to mate with the seal face around the cover and a new cover is installed.

The structure described herein is presently considered to be preferred; however, it is contemplated that further variations and modifications within the purview of those skilled in the art can be made herein. The following claims are intended to cover all such variations and modifications as fall within the true spirit and scope of the invention.

What is claimed is:

1. A subsea drill-thru manifold center for petroleum well completion and production comprising:

a drill-thru manifold center divided into a plurality of compartments by gas tight bulkheads;

a top spool welded to the top of at least one of said plurality of compartments;

a bottom spool welded to the bottom of at least one of said plurality of compartments coaxially with said top spool;

a removable sleeve mounted between said top spool and said bottom spool;

said top spool, bottom spool and removable sleeve defining a conduit for the drilling and completion of a petroleum well while allowing said compartment to remain dry, and wherein said manifold center is further defined as including at least two well cylindrical structures divided into a plurality of compartments and at least two production cylinders interconnecting said well cylindrical structures.

2. The invention defined in claim 1 wherein said removable sleeve comprises a first tubular section and a second tubular section telescopically movable in a sealed relationship within said first tubular section.

3. The invention defined in claim 2 wherein the bottom of said top spool includes an annular flange, the top of said bottom spool includes an annular flange, and said removable sleeve includes an upper and lower annular flange for sealably mating with said top spool's annular flange and said bottom spool's annular flange respectively.

* * * * *